United States Patent [19]

Montagna

[11] 4,132,410

[45] Jan. 2, 1979

[54] RING TOSS GAME WITH SWIVEL COLLAR

[76] Inventor: Anthony R. Montagna, Box 241, Caincrest, York, Me. 03909

[21] Appl. No.: 867,085

[22] Filed: Jan. 5, 1978

[51] Int. Cl.[2] ..... A63B 67/06

[52] U.S. Cl. ..... 273/100; 273/106 B; 273/104

[58] Field of Search ..... 273/100, 104, 106 B

[56] References Cited

U.S. PATENT DOCUMENTS

| | | | |
|---|---|---|---|
| 793,798 | 7/1905 | McConnell | 273/106 B |
| 1,230,503 | 6/1917 | Miller | 273/100 |
| 1,480,563 | 1/1924 | Morgan | 273/100 |
| 1,705,501 | 3/1929 | Sas | 273/100 |
| 2,073,324 | 3/1937 | Stockton | 273/100 |
| 2,076,010 | 4/1937 | String | 273/100 |
| 2,365,513 | 12/1944 | Battle et al. | 273/100 |
| 2,506,932 | 5/1950 | McAfee | 273/106 B |
| 2,666,642 | 1/1954 | Ward | 273/100 |
| 3,119,619 | 1/1964 | Frank | 273/106 B |
| 3,580,580 | 5/1971 | Wark | 273/106 B |

FOREIGN PATENT DOCUMENTS

| | | | |
|---|---|---|---|
| 2261795 | 9/1975 | France | 273/100 |

*Primary Examiner*—William H. Grieb
*Assistant Examiner*—Lawrence E. Anderson
*Attorney, Agent, or Firm*—William Nitkin

[57] ABSTRACT

An improved ring toss game apparatus of the type having a post member with radially projecting arm members and a plurality of ring members to be tossed thereat. The post member of this invention includes a swivel collar member having a radially projecting arm thereon with the post member positioned in either an indoor or outdoor support base. The ring members have a circular central opening concentric with the exterior of the ring member, the top of which when viewed in cross-section forms a half-circle and the bottom of the ring member forming a concave indentation concentric with the top half-circle.

7 Claims, 5 Drawing Figures

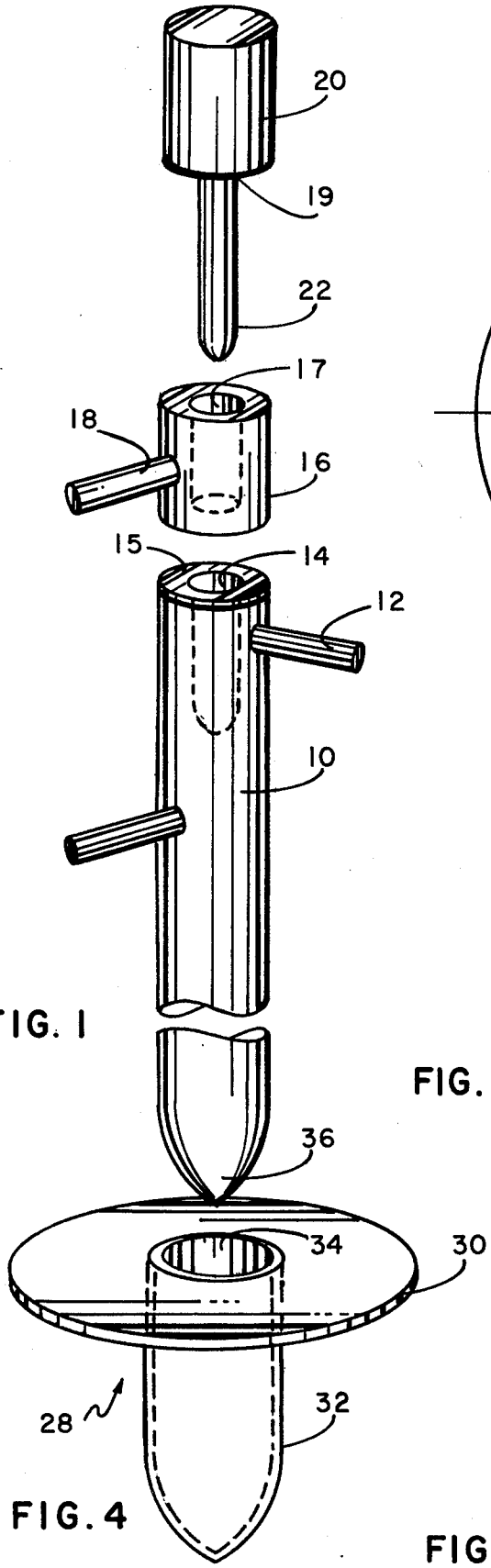
FIG. 1
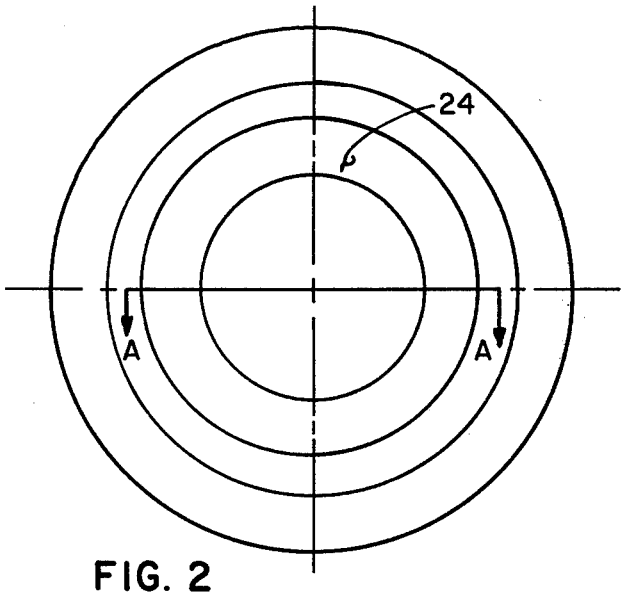
FIG. 2
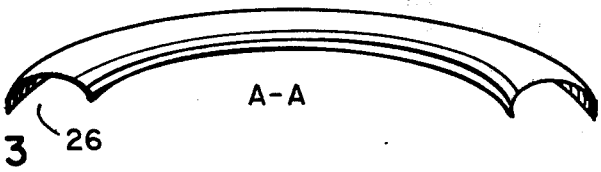
FIG. 3
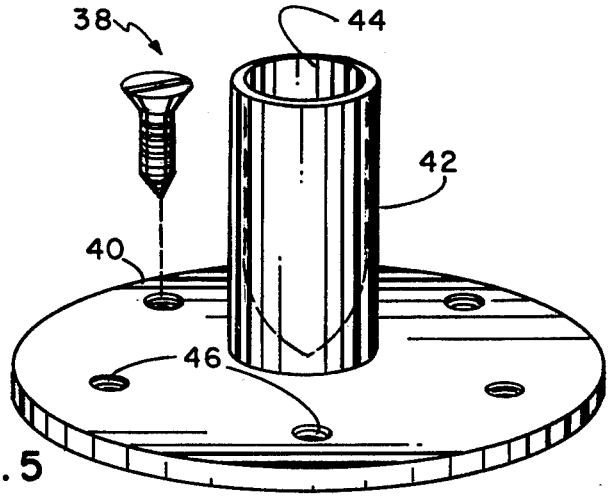
FIG. 4
FIG. 5

RING TOSS GAME WITH SWIVEL COLLAR

BACKGROUND OF THE INVENTION

The device of this invention relates to games and more particularly relates to ring toss games of the type that can be used both indoors and outdoors.

Ring toss games are well-known in the art and usually consist of one or more rings which are tossed onto a post. Such post may have one or more projecting arms to catch the rings as their central apertures pass over and fall in an encircling relationship to such post and may catch on one of the projecting arms. Many of such games have been patented such as Sas, U.S. Pat. No. 1,705,501 which discloses a device having several projections on a turntable which is centrally suspended and rotates while a player throws a ring with the object of dropping his ring over one of the rotating projections. In Morgan, U.S. Pat. No. 1,480,563 the post onto which the rings are thrown oscillates back and forth on a hinge member to make it more difficult to throw the rings onto the post. In MIller, U.S. Pat. No. 1,230,503 there is disclosed means for the support of a ring toss post on a base member for indoor use and one for outdoor use. In Bartle, U.S. Pat. No. 2,365,513 a post is disclosed having pegs projecting therefrom at a variety of angles with a handle at the top of the post. As the post is jerked around by the player, the rings move along to successive pegs by the post's movements. Other types of ring toss games are disclosed in McConnell, U.S. Pat. No. 793,798; Stockton, U.S. Pat. No. 2,073,324; Ward, U.S. Pat. No. 2,666,642; and Frank, U.S. Pat. No. 3,119,619. In the Frank patent the post has a specially adapted flange at its base to prevent rotation thereof when heavy iron rings are thrown at the post. In McAfee, U.S. Pat. No. 2,506,932 a design for a quoit having a specially designed shape is disclosed.

SUMMARY

It is an object of the present invention to disclose a novel ring toss game. Seen in this game apparatus is a unique ring member structure, a post member having one or more radially projecting arm members along its sides with a projection receipt hollow located at its top, and a swivel collar member having a collar arm member projecting therefrom with a swivel collar aperture defined vertically therethrough. The swivel collar member is located at the top of the post member and held in position by a cap member having a downward projection adapted to pass through the swivel collar aperture and to be received by the projection receipt hollow of the post member so that the collar arm member spins freely as the swivel collar rotates on the cap member's projection. The base of the post member can be tapered and inserted into an outdoor base having a receipt aperture defined within its downwardly extending projection with an associated flange member affixed to its top to prevent lateral tipping of the post member when rings are tossed at the post member. When the game is used indoors, the post member can be positioned in an indoor base having a receipt member with an aperture defined therein into which the post member is inserted and have a flange member affixed to the base of the indoor base which can rest on the ground. A series of flange apertures can be defined within the flange of the indoor base to be affixed by screws or other means to a non-movable surface. The ring members utilized in this game are circular in shape and have a circular central opening concentric with the exterior of the circular ring, the top of which when viewing a cross-section thereof forms a half-circle and the bottom of which forms a concave indentation concentric with the top half-circle. The ring members used in this game can have varying diameters. The novel aspect of the ring members is that they have a tendency to "sail" or "float" when thrown.

It is an object of this invention to present a challenging game to its players due to the swivel collar arm rotating in a variety of positions when struck by a ring member. The object of the game is for a player to toss his ring member so that it falls around the cap member and falls down the post member to hang on one of the radially-projecting arms to which different scores can be associated therewith. The players of the game must develop skill in throwing the ring members which are aerodynamically designed to have a tendency to sail when tossed.

Further details of the device of this invention and its uses and advantages will become clearer when reference is made to the drawings and Description of the Preferred Embodiment.

BRIEF DESCRIPTION OF THE DRAWINGS

FIG. 1 is a view of the post member of this invention in extended form.

FIG. 2 is a top view of the ring member of this invention.

FIG. 3 is a cross-sectional view through A—A of FIG. 2 of the ring member of this invention.

FIG. 4 illustrates an outdoor base adapted for use with this invention.

FIG. 5 illustrates an indoor base adapted for use with this invention.

DESCRIPTION OF THE PREFERRED EMBODIMENT

FIG. 1 illustrates an extended view of post member 10 of this invention. Shown thereon is radially extending arm member 12. There can be one or more radially extending arms in different positions and at different angles along the post member in either equal or unequal distances from one another. Defined within the top of post member 10 is projection receipt hollow 14. The top of the post member is substantially flat and can be coated with an optional friction-reducing material 15 such as Teflon, a trade name for a slippery synthetic polymer. Ball bearing members can also be utilized or an equivalent friction-reducing means. Swivel collar member 16 rests on the top of post member 10 and has extending therefrom a collar arm member 18. Collar arm member 18 as well as arm member 12 can extend either horizontally or at an upward angle. Cap member 20 has downwardly extending cap projection member 22 adapted to be inserted within swivel collar aperture 17 defined within swivel collar member 16. Swivel collar aperture extends completely through swivel collar member 16. Cap member projection 22 is inserted through swivel collar aperture 17 and into projection receipt hollow 14 of post member 10 where it can be snugly held. Friction-reducing material 15 can optionally be utilized at the junction between cap member 20 and swivel collar member 16 as denoted by exemplary coating 19 on cap member 20. This coating or equivalent can also be applied to cap member 20 as discussed above. It should be noted that swivel collar member 16 should rotate freely when collar arm member 18 is struck by ring member 24 illustrated in FIG. 2. The base 36 of post member 10 can be tapered and is inserted into either of the base members described below. Post member 10 can be constructed of wood, plastic, metal or any equivalent material to serve the purposes of the game. The ring toss game of this invention can be played by one or more players utilizing one or more ring members. Ring members 24 utilized in this game as seen in FIG. 2 is circular and has a round aperture defined centrally therein. A cross-sectional view shown in FIG. 3 through section A-A of FIG. 2 more clearly illustrates the structure of ring member 24 which in cross-section comprises a half-circle with a concave hollow 26 causing the ring member to be aerodynamic when thrown with the hollow 26 of the ring member facing downwards in order for the ring member to have a sailing effect when tossed. The ring member can be constructed of plastic, metal, rubber composition, foam composition, molded plywood or of any equivalent material.

FIG. 4 illustrates outdoor base 28 which has at its base a hollow projection 32 which can be tapered so that it can be driven into the ground. Flange member 30 extends outward from the top thereof and prevents lateral tipping of outdoor base 28. Receipt aperture 34 defined within projection 32 is designed to receive the tapered base 36 of post member 10 for snug insertion therein. If it is desired to play the game of this invention indoors, indoor base 38 having post receipt member 42 with a post receipt aperture 44 defined therein adapted to receive base 36 in a snug fitting manner can be utilized. Assisting in holding indoor base 38 upright is indoor base flange member 40 affixed to the base of post receipt member 42 to prevent tipping when post member 10 is struck by a ring member. Indoor base flange member 40 can also have a series of flange apertures 46 defined therein for receipt of screw members to affix indoor base 38 permanently to a stationary surface.

The scoring of the game can be achieved in a variety of ways. For example, one score can be achieved by throwing a ring member and catching it on collar arm member 18. Another score can be achieved by catching a ring member on one of the radially projecting arm members 12, with a third score achieved if a player is able to get a ring member completely to the base of post member 10. The scoring can vary according to the wishes of the players of the game.

Although the present invention has been described with reference to particular embodiments, it will be apparent to those skilled in the art that variations and modifications can be substituted therefor without departing from the principles and spirit of the invention.

I claim:

1. An improved ring toss game wherein the improvement comprises:

a post member;

at least one radially projecting arm members extending from said post member;

a projection receipt hollow defined in the top of said post member;

a swivel collar member having a radially projecting collar arm member thereon;

a swivel collar member aperture defined within said swivel collar member extending vertically therethrough;

a cap member having a projection member extending downward therefrom adapted to pass through said swivel collar member aperture and to be received into said projection receipt hollow of said post member so that said swivel collar is held snugly to the top of said post member in a manner that allows said collar member to rotate freely when struck; and at least one circular ring member having a circular opening defined centrally therein concentric with the exterior of said ring member, the top of which when viewed in cross-section forms a half-circle and the bottom of said ring member forming a concave indentation concentric with the top half-circle.

2. The device as recited in claim 1 further including friction reducing means between said post member and said cap member to assist said swivel collar member to rotate freely when struck.

3. The device as recited in claim 1 wherein there are a plurality of circular ring members of varying sizes.

4. The device as recited in claim 1 wherein said post member has a tapered base.

5. The device as recited in claim 1 further including:

an outdoor base having a hollow tapered projection at its base;

a receipt aperture defined within said hollow projection adapted to receive the base of said post member; and a flange member affixed to the top of said hollow projection adapted to prevent lateral tipping of said post member.

6. The device as recited in claim 1 further including:

an indoor base having a post receipt member;

a post receipt aperture defined within said post receipt member adapted to receive the base of said post member; and an indoor base flange member affixed to the base of said indoor base adapted to hold said post member in a stationary position.

7. The device as recited in claim 6 further including a plurality of flange apertures defined within said indoor base flange member for receipt of affixation means for securing said indoor base to a stationary surface.

* * * * *